US007107882B1

(12) United States Patent
Chang

(10) Patent No.: US 7,107,882 B1
(45) Date of Patent: Sep. 19, 2006

(54) SLIP-RESISTANT MAGNETIC SHEATH FOR A SCREWDRIVER

(76) Inventor: Wun-Hai Chang, No. 11, Lane 48, Sijhou Rd., Taiping City, Taichung County (TW)

( * ) Notice: Subject to any disclaimer, the term of this patent is extended or adjusted under 35 U.S.C. 154(b) by 0 days.

(21) Appl. No.: 10/955,413

(22) Filed: Oct. 1, 2004

(51) Int. Cl.
*B25B 23/08* (2006.01)
*B25B 13/02* (2006.01)

(52) U.S. Cl. ..... 81/451; 81/125; 81/438

(58) Field of Classification Search ..... 81/451, 81/125, 438, 177.85
See application file for complete search history.

(56) References Cited

U.S. PATENT DOCUMENTS 772,912 A * 10/1904 Allam ..... 81/451
2,235,235 A * 3/1941 Price ..... 81/451
3,392,767 A * 7/1968 Stillwagon, Jr. ..... 81/451
3,739,825 A * 6/1973 Knox ..... 81/451
3,884,282 A * 5/1975 Dobrosielski ..... 81/439
4,736,658 A * 4/1988 Jore ..... 81/451
5,724,873 A * 3/1998 Hillinger ..... 81/451

* cited by examiner

*Primary Examiner*—Lee D. Wilson
*Assistant Examiner*—Alvin J Grant
(74) *Attorney, Agent, or Firm*—Egbert Law Offices

(57) ABSTRACT

A slip-resistant magnetic sheath includes a hollow sleeve that can be fit onto the screwdriver's shank. A magnetic part positioned at least on one end of the hollow sleeve, provides auxiliary attraction to improve the connection between the shank and the screw with a fastening rim and groove set correspondingly on the sleeve of the magnetic sheath and the shank. The groove allows the fastening rim to move within a pre-set distance so that the magnetic sheath can slide within certain distance and not fall off the shank. The invention installed on an electrical screwdriver can effectively address the slipping problem caused by shocking. The forceful magnetic attraction of the magnetic sheath can prevent the screws from slipping and therefore improve working efficiency.

3 Claims, 6 Drawing Sheets

SLIP-RESISTANT MAGNETIC SHEATH FOR A SCREWDRIVER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a magnetic sheath for the screwdriver, and more particularly to a magnetic sheath which comprises a corresponding fastening rim and groove to prevent it from sliding or detaching.

BACKGROUND OF THE INVENTION

Due to the loose connection between the screwdriver head and the groove of the screw, traditional screwdrivers (such as a cross screwdriver and straight screwdriver) often lose screws while screwing and therefore affect the effectiveness of work. Though the screwdrivers might be magnetized, the magnetic force is too weak and short to solve the problem for good. In a fast developing world, efficiency is deemed to be the most important. Electrical screwdrivers have become an indispensable tool. However, it shocks so severe that the screws often fall off the screwdriver and causes much inconvenience to the users and accordingly affects efficiency.

Therefore, a new invention is called for to solve above problems.

In light of this, drawing on years' experience in the design and manufacturing of relevant products, this inventor proposes a practical invention after careful design and evaluation to achieve above purpose.

BRIEF SUMMARY OF THE INVENTION

1. By setting a fastening rim and groove correspondingly on the magnetic sheath and the shank, the magnetic sheath can move with a pre-set distance and be fastened on the shank. Therefore, the magnetic sheath can keep on the shank as the screw detached from the shank.

2. The application of this invention on an electrical screwdriver can effectively address the slipping problem caused by the shocking. The forceful magnetic attraction of the magnetic sheath can prevent the screws from slipping and therefore improve the working efficiency.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
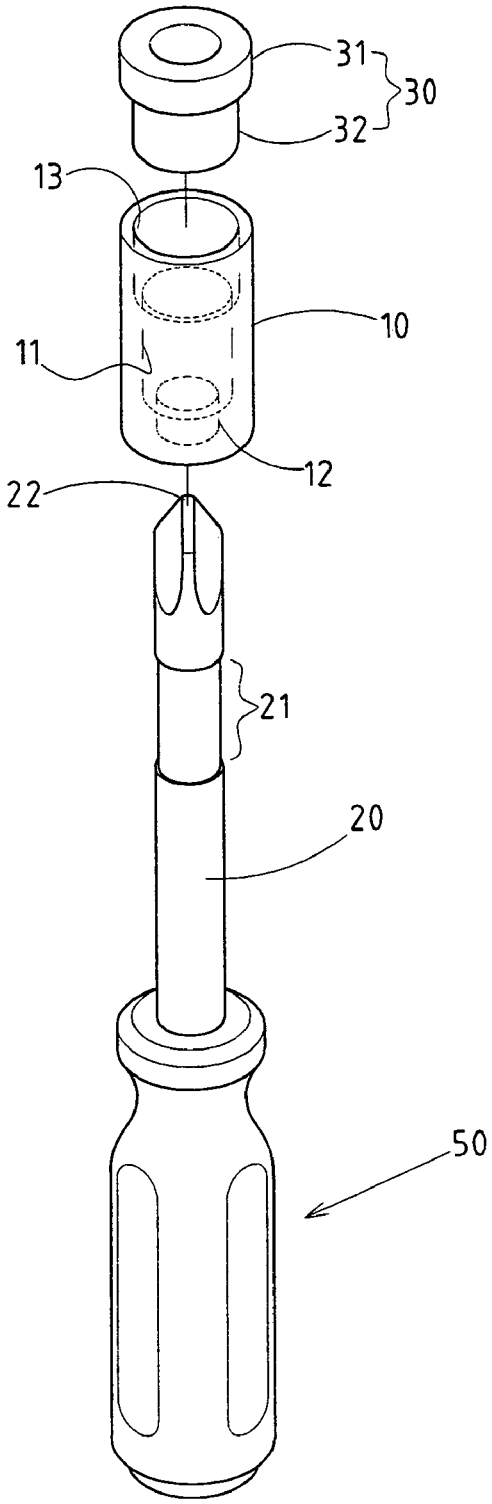
FIG. 1 shows an exploded perspective view of the preferred embodiment of the present invention.
Figure 2:
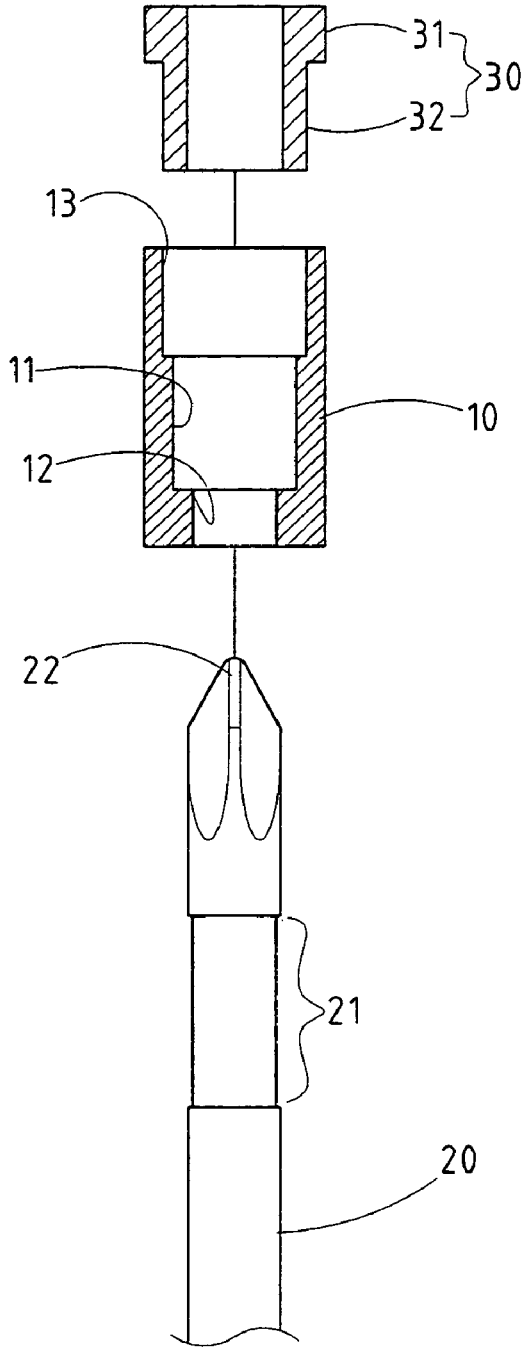
FIG. 2 shows an exploded sectional view of the magnetized sheath of the invention.
Figure 3:
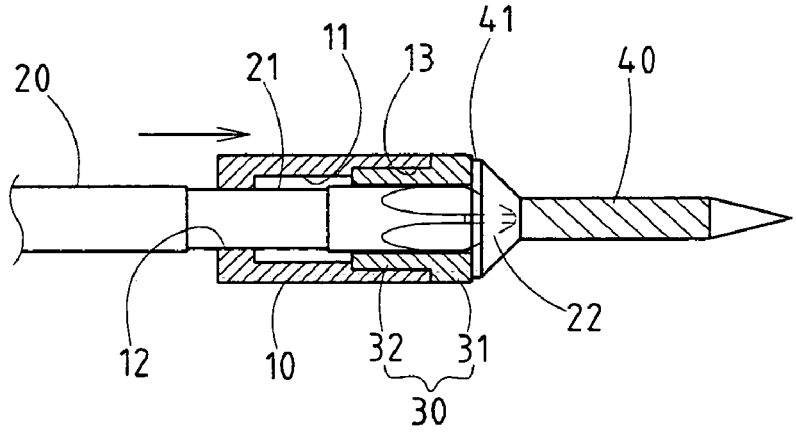
FIG. 3 shows another sectional view of the installed invention, magnetizing a screw.

As shown in FIGS. 1–3, there is a slip-resistant magnetic sheath for the screwdriver embodied in the present invention.

The invention includes a hollow magnetic sheath 10, whose sleeve 11 can fit into the shank 20 of the screwdriver. The magnetic part 30 at one end can provide secondary sticking force to improve the connection between the screwdriver shank 20 and screws 40. The sleeve 11 of the magnetic sheath 10 and the screwdriver shank 20 have corresponding fastening rim and groove. In this case, the fastening rim 12 can be set within the sleeve 11 of the magnetic sheath 10 and in the shape of internal protruding rim with axial direction length. The fastening groove 21 is set at the parameter of the shank 20 and in the shape of concave groove with pre-set axial direction length. The pre-set length of the fastening groove 21 can allow the fastening rim 12 to move within pre-set distance.

Figure 4:
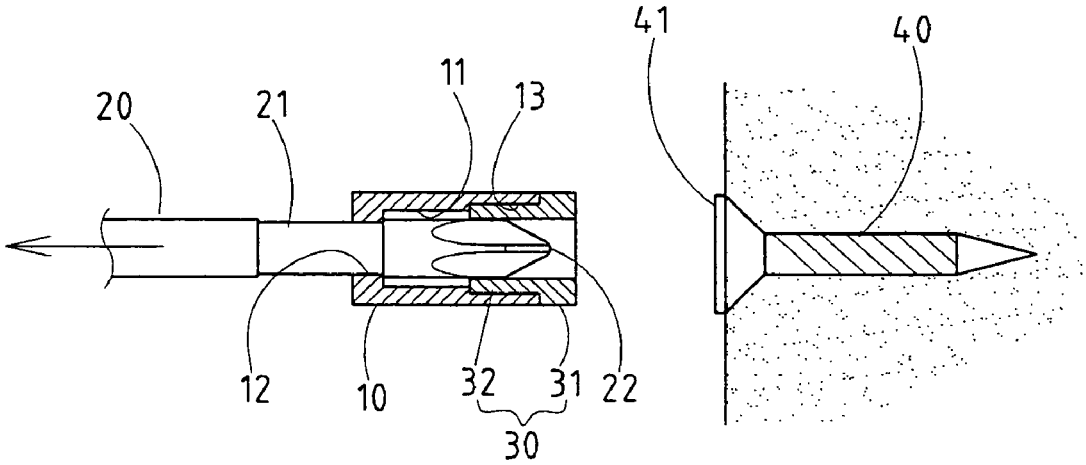
FIG. 4 shows still another sectional view of the installed invention, the removal of a screw.
Figure 5:
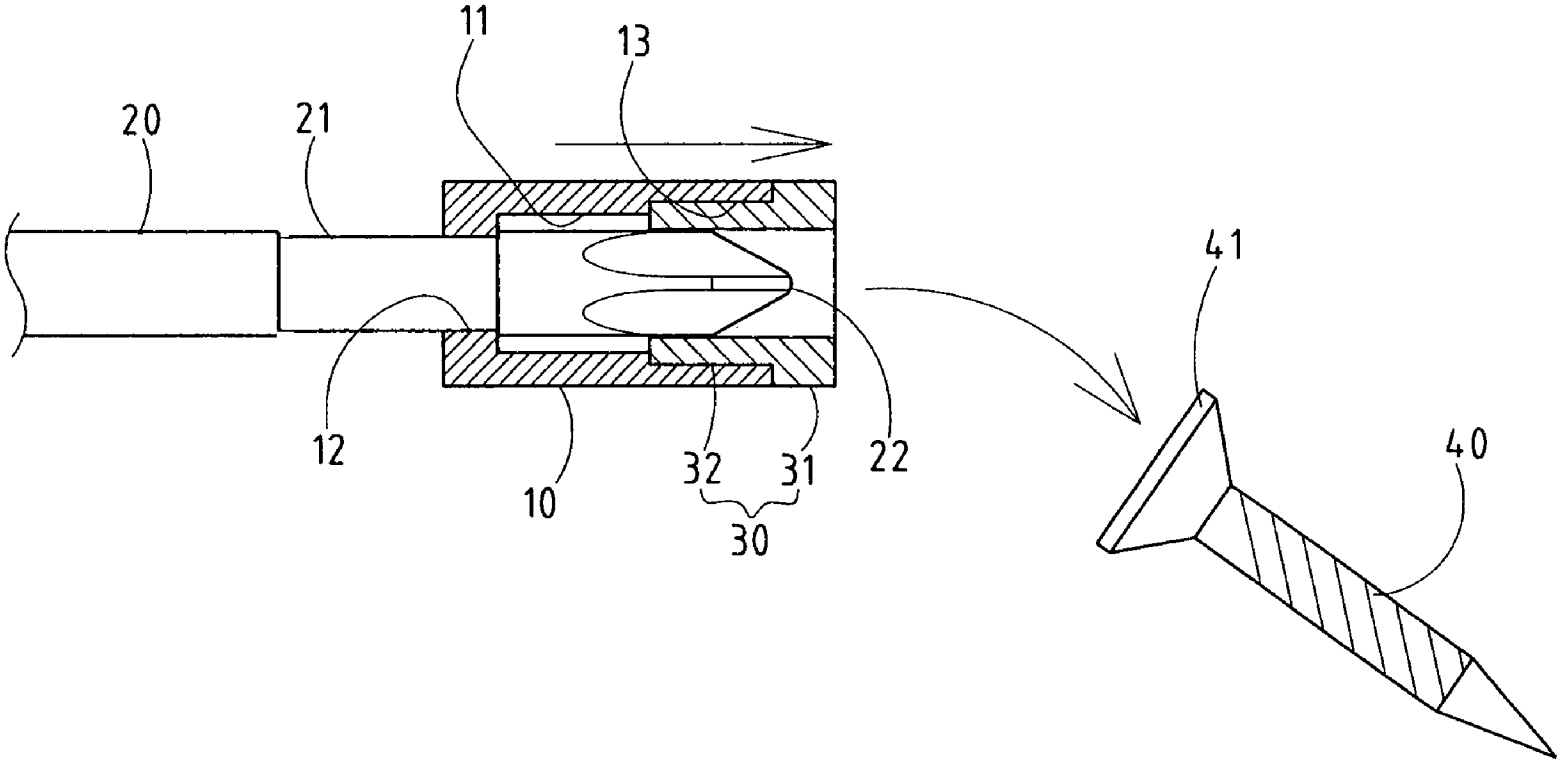
FIG. 5 shows a sectional view of the installed invention, the removal of the screwdriver shank and magnetic sheath after locking the screw.

When the magnetic sheath 10 is pushed forward and arrives at stop position (as shown in FIG. 5), its front end should surpass the screwdriver's end for a certain length. Therefore the screw 40 can be detached from the front end of the screwdriver 22 removed easily in a way similar to that of breaking off. When the magnetic sheath 10 slides backwards, the magnetic sheath 10 can move back to the fixed position of the fastening groove 21. Push forward the magnetic sheath 10 forward and the screw head 41 can be magnetically attracted firmly (to lock the screws). As shown in FIG. 4, as the screwdriver's shank is detached from the screw 41, the magnetic sheath 10 is positioned at the screwdriver's shank 20 and keeps attracted on the shank to prevent it from slipping or being attracted on the screws.

The magnetic sheath 10 and the magnetic part 30 can be manufactured as two separate components. The magnetic sheath 10 can be made of plastic material. The front end of the sleeve 11 can be formed as an expanding part 13 so that the magnetic part 30 can be shaped in phased column and divided into big diameter part 31 and small diameter part 32. The small diameter part can fit into the expanding part 13 of the sleeve 11 of the magnetic sheath 10. The big diameter part 20 of the magnetic part 30 can meet the outer diameter of the magnetic sheath 10. Furthermore, the magnetic part 30 can be of single diameter and fit into the expanding part 13 entirely. Therefore, the section of the magnetic part 30 can meet that of the expanding part 13.

When the magnetic sheath 10 is used, the fastening rim 12 of the sleeve 11 is forced to surpass the front part 22 of the screwdriver's shank (the magnetic sheath is made of plastic material and with certain tenacity). When the fastening rim 12 reaches the fastening groove 21 of the screwdriver's shank 20, the magnetic sheath can retract to recover its original diameter so that the fastening rim 12 can move within the distance set by the groove 21 and is incapable of slipping off.

Figure 6:
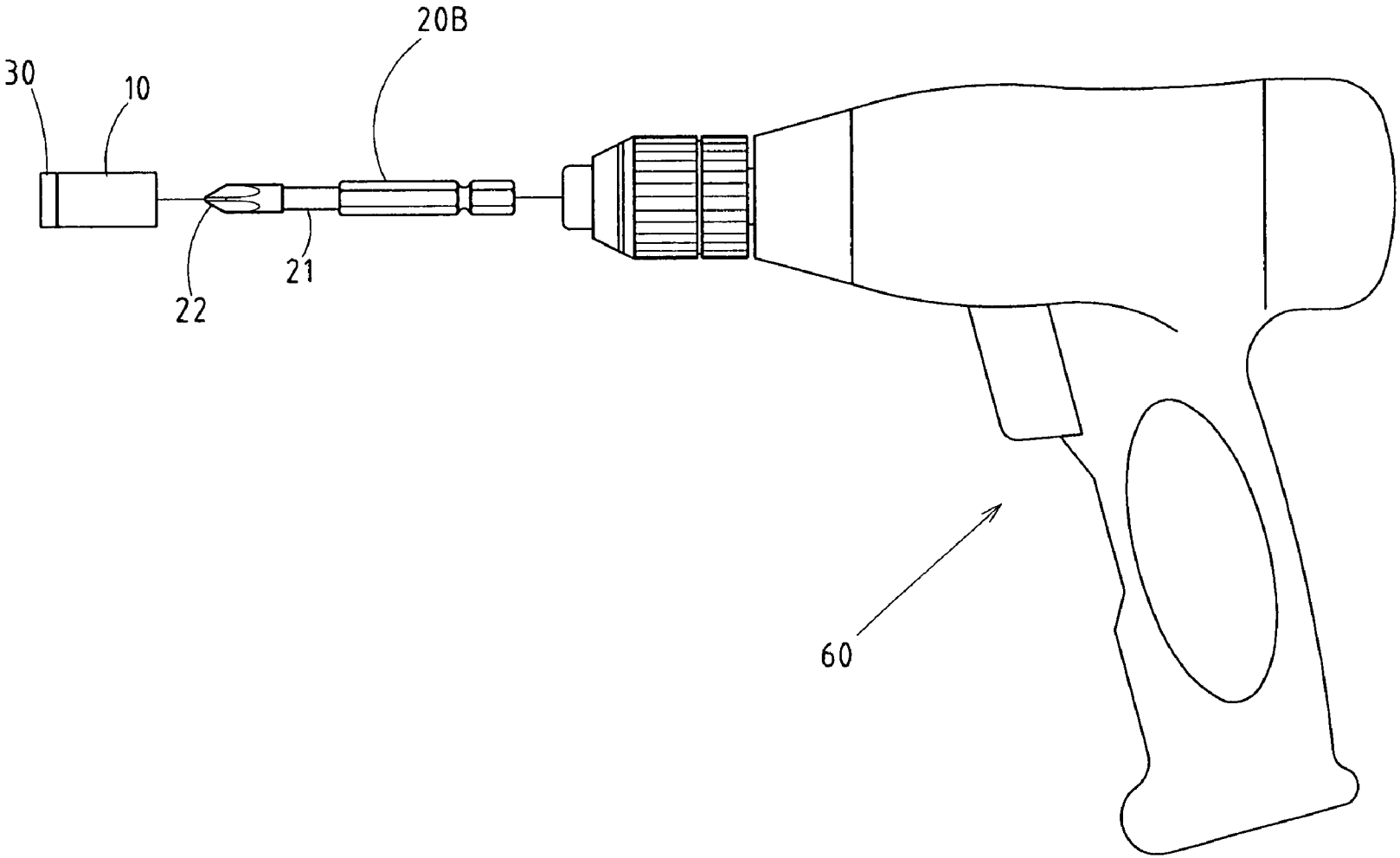
FIG. 6 shows an elevation view of the application for the screwdriver shank.

The shank 20 revealed by this invention can be used not only on common manual screwdriver 50 (as shown in FIG. 1), but also on the shank 20B shown in FIG. 6 and assembled on electrical screwdriver 60. This magnetic sheath 10 can effectively address problems caused by the shocking. The magnetic sheath 10 can attract screw 40 forcefully and prevent it from slipping. Therefore, the working efficiency can be dramatically improved.

Figure 7:
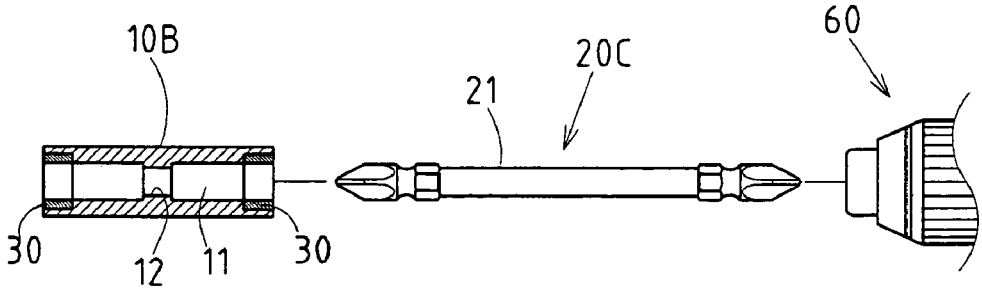
FIG. 7 shows an exploded sectional view of the application for the screwdriver shank.
Figure 8:
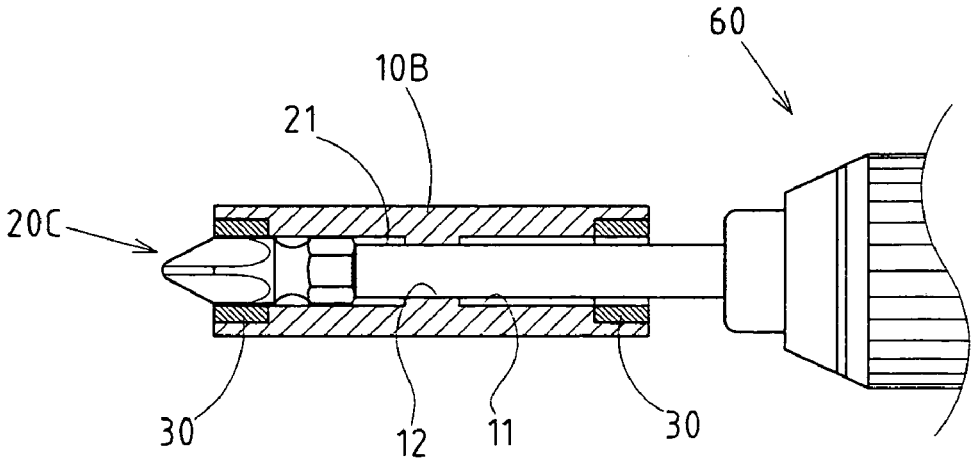
FIG. 8 shows another sectional view of the application on the screwdriver shank.

The screwdriver's shank 20 20B revealed in this invention can be single head as well as double heads. As shown in FIGS. 7 and 8, in the middle of the shank 30C there is a groove 21 which allows the fastening rim 12 of the magnetic sheath 10B to move within the groove 21. The magnetic sheath 10B can move to both ends of the shank 20C. Both ends of the magnetic sheath 10B can have magnetic part 30 so that the magnetic sheath 10B works in both cases.

I claim:

1. An apparatus comprising:

a screwdriver having a handle with a shank extending therefrom, said screwdriver having a tip at an end opposite said handle, said shank having a fastening groove formed thereon adjacent said tip, said fastening groove defining narrow diameter on said shank and a shoulder adjacent said tip;

a hollow sleeve having a fastening rim slidably positioned over said fastening groove of said shank, said shoulder abutting said fastening rim when said sleeve sides outwardly of said tip so as to retain said sleeve on said shank, said fastening rim extending inwardly at one end of said sleeve; and a magnetic part affixed to an opposite end of said sleeve, said magnetic part having an outer surface suitable for magnetically connecting to a screw head, said magnetic part having interior passageway, said tip of said screwdriver slidable through said interior passageway as said fastening rim moves toward said shoulder.

2. The apparatus form claim 1, said magnetic part extending outwardly beyond said tip when said fastening rim abuts said shoulder.

3. The apparatus of claim 1, said magnetic part having a small diameter portion and a large diameter portion, said small diameter portion affixed within said sleeve, said large diameter portion having a diameter equal to an outer diameter of said sleeve.

* * * * *